United States Patent [19]

Konnert

[11] 4,326,894

[45] Apr. 27, 1982

[54] PROCESS FOR THE PRODUCTION OF CONVERSION LAYERS ON METAL SURFACES BY THE SPRAY METHOD

[75] Inventor: Wolfgang Konnert, Frechen, Fed. Rep. of Germany

[73] Assignee: Gerhard Collardin GmbH, Cologne, Fed. Rep. of Germany

[21] Appl. No.: 272,717

[22] Filed: Jun. 11, 1981

Related U.S. Application Data

[63] Continuation of Ser. No. 150,189, May 15, 1980, abandoned.

[30] Foreign Application Priority Data

May 13, 1979 [DE] Fed. Rep. of Germany ..... 2922115

[51] Int. Cl.[3] ..... C23F 7/00; C23F 7/26

[52] U.S. Cl. ..... 148/6.14 R; 148/6.2; 148/6.27; 118/316

[58] Field of Search ..... 148/6.14 R, 6.2, 6.27, 148/6.15 R, 6.15 Z; 427/424, 300; 118/314, 73, 315, 316; 156/640

[56] References Cited

FOREIGN PATENT DOCUMENTS 52-15269 2/1977 Japan ..... 156/640

863098 3/1961 United Kingdom .

OTHER PUBLICATIONS

"Metalloberflache-Angewandte Eletrrochemie", 25, pp. 1-6, 53-56, 75-80, 132-134, 153-159 (1971).

*Primary Examiner*—Ralph S. Kendall

*Attorney, Agent, or Firm*—Hammond & Littell, Weissenberger and Muserlian

[57] ABSTRACT

In the process for the production of conversion layers continuously on a continuously moving band or sheet-like metal surfaces of aluminum, zinc or iron, by the application of a solution creating a layer on said metal surfaces selected from the group consisting of a chromating solution, an acid solution free of chromic acid and containing fluorides and compounds of titanium, zirconium or manganese, an acid solution free of chromic acid containing fluorides, and an acid solution free of chromic acid containing compounds of titanium, zirconium or manganese, by the stationary spray method, onto the cleaned and rinsed metal surface, and subjecting said metal surfaces to customary aftertreatments, the improvement consisting in that said solution creating a layer on said metal surfaces is sprayed through at least one two-component jet spray nozzle with the aid of an inert compressed gas where said solution and said compressed gas are fed separately each to an opening in said two-component jet spray nozzle.

8 Claims, 3 Drawing Figures

PROCESS FOR THE PRODUCTION OF CONVERSION LAYERS ON METAL SURFACES BY THE SPRAY METHOD

This is a continuation of Ser. No. 150,189, filed May 15, 1980, abandoned.

BACKGROUND OF THE INVENTION

The present invention relates to an improved process for the production of conversion layers continuously on a continuously moving band or sheet-like metal surfaces of aluminum, zinc or iron by the application of a chromating solution or acid solution free of chromic acid and containing fluorides and/or compounds of titanium, zirconium or manganese, by the stationary spray method, where the solution is applied through a two-component jet spray nozzle with the aid of an inert compressed gas.

The producing of conversion layers by the spray method is known as such. For example, Ries reports, in "Metalloberflache—Angewandte Elektrochemie," 25, pages 1-6, 53-56, 75-80, 132-134, 153-159 (1971), a summary of process technology and processes for the producing of conversion layers on metal bands, and discusses also in this connection the respective spray methods. In the conventional spray methods, the respective treatment solution is sprayed on both sides of the cleaned and degreased metal band or a metal tablet with a jet system, while the spray pressure needed for this process is produced and controlled by a suitable pump. In general, spray pressures of about 0.7 to 1.5 bar over atmospheric pressure are used; however, the pressure can be increased to values of 10 to 100 bar for special high-pressure spray methods.

Common to all of these methods is the fact that they require complex pumping systems made of materials resistant to chemicals, which, on the one hand, can resist the aggressive ingredients of the treatment solutions and, on the other, guarantee a constant but controllable spray pressure. Added to this is the fact that usually relatively large volumes of liquid are sprayed on per square meter of metal surface by the known methods, which necessitate the rinsing or squeezing off of excess treatment solution after the completed reaction.

OBJECTS OF THE INVENTION

An object of the present invention is to provide a spray method for the producing of conversion layers that eliminates the disadvantages mentioned above and, in particular, makes the use of technically complex, as well as financially expensive, pressure pumps superfluous.

Another object of the present invention is the development of an improvement in the process for the production of conversion layers continuously on a continuously moving band or sheet-like metal surfaces of aluminum, zinc or iron, by the application of a solution creating a layer on said metal surfaces selected from the group consisting of a chromating solution, an acid solution free of chromic acid and containing fluorides and compounds of titanium, zirconium or manganese, an acid solution free of chromic acid containing fluorides, and an acid solution free of chromic acid containing compounds of titanium, zirconium or manganese, by the stationary spray method, onto the cleaned and rinsed metal surface, and subjecting said metal surfaces to customary aftertreatments, the improvement consisting in that said solution creating a layer on said metal surfaces is sprayed through at least one two-component jet spray nozzle with the aid of an inert compressed gas where said solution and said compressed gas are fed separately each to an opening in said two-component jet spray nozzle.

A further object of the present invention is the development of an improvement in the process for the application of an even flow of an aqueous acidic solution onto a moving metal surface by passing said aqueous acidic solution under pressure through an stationary orifice directed onto said metal surface, the improvement consisting of passing said aqueous acid solution through one opening of at least one two-component jet orifice and passing an inert compressed gas through the other opening of said at least one two-component jet orifice.

These and other objects of the present invention will become more apparent as the description thereof proceeds.

THE DRAWINGS

DESCRIPTION OF THE INVENTION

Figure 1:
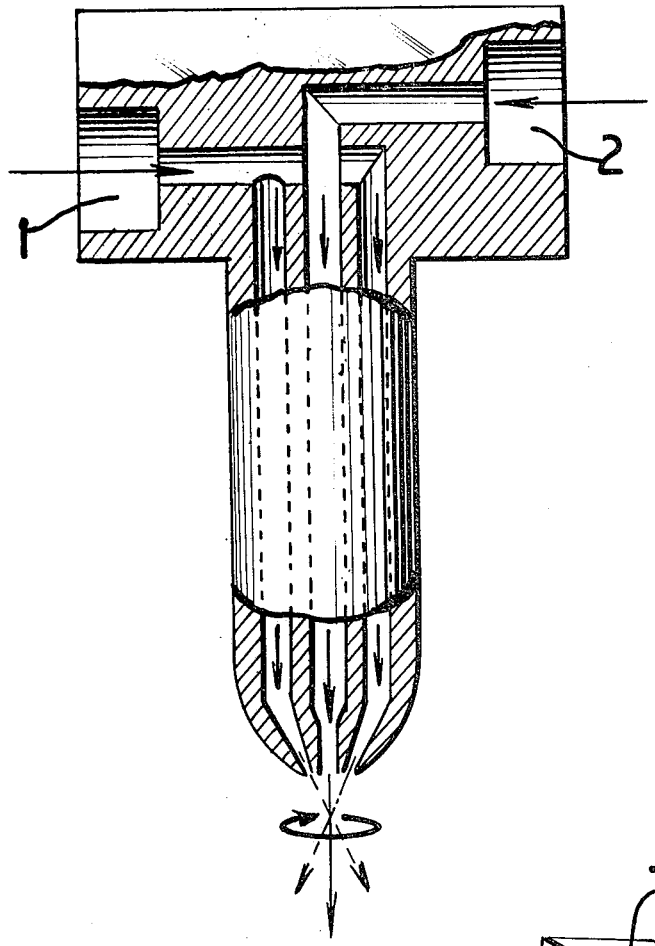
FIG. 1 is a cross-sectional view of a two-component jet nozzle.

The subject of the invention is a process for the production of conversion layers continuously on moving, band- or sheet-like metal surfaces of aluminum, zinc or iron by the application of a chromate solution or an acid solution free of chromic acid and containing fluorides and/or compounds of titanium, zirconium or manganese by the spray method, characterized by the fact that the solution is sprayed on the cleaned and rinsed metal surfaces with the aid of inert compressed gas through one or several two-component jet nozzles, in which the solution and the compressed gas are fed separately into the jet opening, and that the metal surface is subsequently treated in a known manner.

More particularly, the present invention relates to the improvement in the process for the production of conversion layers continuously on a continuously moving band or sheet-like metal surfaces of aluminum, zinc or iron, by the application of a solution creating a layer on said metal surfaces selected from the group consisting of a chromating solution, an acid solution free of chromic acid and containing fluorides and compounds of titanium, zirconium or manganese, an acid solution free of chromic acid containing fluorides, and an acid solution free of chromic acid containing compounds of titanium, zirconium or manganese, by the stationary spray method, onto the cleaned and rinsed metal surface, and subjecting said metal surfaces to customary aftertreatments, the improvement consisting in that said solution creating a layer on said metal surfaces is sprayed through at least one two-component jet spray nozzle with the aid of an inert compressed gas where said solution and said compressed gas are fed separately each to an opening in said two-component jet spray nozzle.

Surprisingly, it has been found that the use of such two-component nozzles makes the spraying of the respective treatment solutions on the metal surfaces with the aid of compressed gas possible, the amount of liquid to be applied being controlled exclusively through the pressure regulation of the compressed gas that is used. The use of technically complex pressure and control pumps thus can be eliminated since the application of the process according to the invention permits a sure and effective distribution of the liquid on the metal surfaces, even with different belt conveyor speeds of the continuously operating equipment. The advantages of the process according to the invention thus are found on the one hand, in an improved control over the entire spraying process as well as, on the other hand, in a simpler construction of the spray aggregates needed for this purpose.

The new process can be used advantageously for the producing of conversion layers—which frequently are called conversion coatings in the literature—on aluminum, iron, steel, zinc or zinc-coated steel surfaces. The continuously moving metal surfaces to be treated can run through the continuously operating equipment in the form of continuous belts as well as in the form of plates or sheets on some type of a conveyor or conveyor chain for this purpose.

Before the actual conversion treatment, the metal surfaces are subjected to a cleaning or degreasing process in a known manner and then thoroughly rinsed with water. Alkaline baths with sodium hydroxide solution that may also contain polyphosphates, complexing agents and wetting agents usually are used for degreasing. Depending on the degree of soiling of the metal surfaces, it may be advantageous to boost the cleaning action by the use of rotating pairs of brushes, as well as to intensify the entire cleaning process by subdividing it into several successive steps, such as predegreasing and post-degreasing, whereby cleaning solutions of the same or different composition can be sprayed on the metal surfaces in a cycle with or without pressure in the different treatment zones. Repeated rinsing of the degreased metal surfaces is desirable for the subsequent thorough removal of the cleaning chemicals; the metal surfaces usually are flooded with recycled industrial water for this purpose. The use of cold water, i.e., water at room temperature, in the rinsing zone, and heated water with a temperature of 50° to 70° C., for example, in the next zone was found to be advantageous. After passing the last rinsing zone, the conversion layers are produced by spraying the respective treatment solutions in the manner according to the invention.

The conversion layers in amounts of from 0.01 to 1 $gm/m^2$, preferably from 0.2 to 0.5 $gm/m^2$, are produced by spraying the treatment solution on the metal surfaces in an amount and concentration sufficient to deposit the desired conversion layer. The amount and concentration of the treatment solution is readily determined by those skilled in the art.

The well-known chromating solutions that usually contain phosphoric acid, nitric acid and/or hydrofluoric acid as well as, if desired, polyvalent metal ions, free fluorides or fluoride complexes and modifying additions besides the chromic acid or alkaline chromates can be used, for example, for the conversion treatment. Such solutions usually contain from 0.5 to 60 gm/l of $CrO_3$, 2 to 285 gm/l of $PO_4^{3-}$ and/or $NO_3^-$, 0 to 12.5 gm/l of $F^{-0}$ and 0 to 100 gm/l of water-soluble to water-dispersible film-forming polymeric resins.

However, solutions without chromic acid that contain mainly phosphoric acid, for example, as well as fluorides and/or compounds of titanium, zirconium and manganese and also modifying additives may also be used for the process according to the invention. Such solutions usually contain from 2 to 250 gm/l of $PO_4^{3-}$ with optional amounts of from 0 to 12.5 gm/l of $F^-$ and/or $Ti^{4+}$, $Zi^{4+}$ or $Mn^{2+}$. These solutions often contain from 0 to 100 gm/l of lower alkanolamines such as mono, di or triethanolamine and/or water-soluble to water-dispersible film-forming polymeric resins.

Two-component jet nozzles of a known design can be used for the spraying of the respective treatment solutions on the metal surfaces, in which solution and compressed gas are fed to the jet opening in channels that are separated from each other, so that they meet only at the jet opening. FIG. 1 shows the basic design of such a two-component jet in the cross-section. Here, 1 shows the inlet of the compressed gas as well as the compressed gas channel and 2 shows the inlet for the treatment solution as well as the respective channel. If desired, the solution may also be fed through channel 1 and the compressed gas through channel 2, however. Suitable materials for each two-component jets are basically all those of which the jets in conventional spray equipment for the production of conversion layers are made, such as refined steel. Similar considerations apply to the jet openings of the two-component nozzles to be used according to the invention. Jet openings in the range from 0.7 to 2.5 mm can be used in general. The location of the two-component jet nozzles in the actual treatment zone can be seen in FIGS. 2 and 3.

Figure 2:
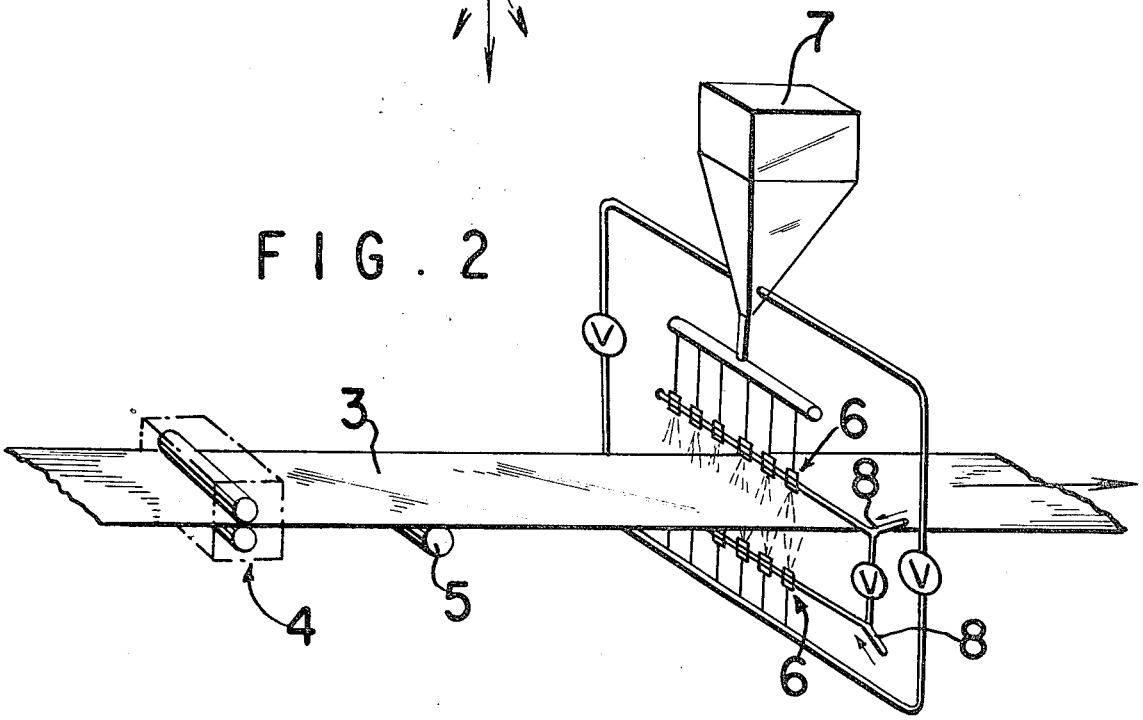
FIG. 2 is a perspective view of the metal band being treated by the process of the invention.

FIG. 2 shows, in perspective, the course of a metal band 3, which traverses the treatment zone in the direction indicated by arrows. Here, 4 is a pair of squeeze rollers, 5 a supporting roller with adjustable height, 6 the two-component nozzles located above and below the metal band, 7 the storage tank for the treatment solution and 8 the compressed gas inlet.

Figure 3:
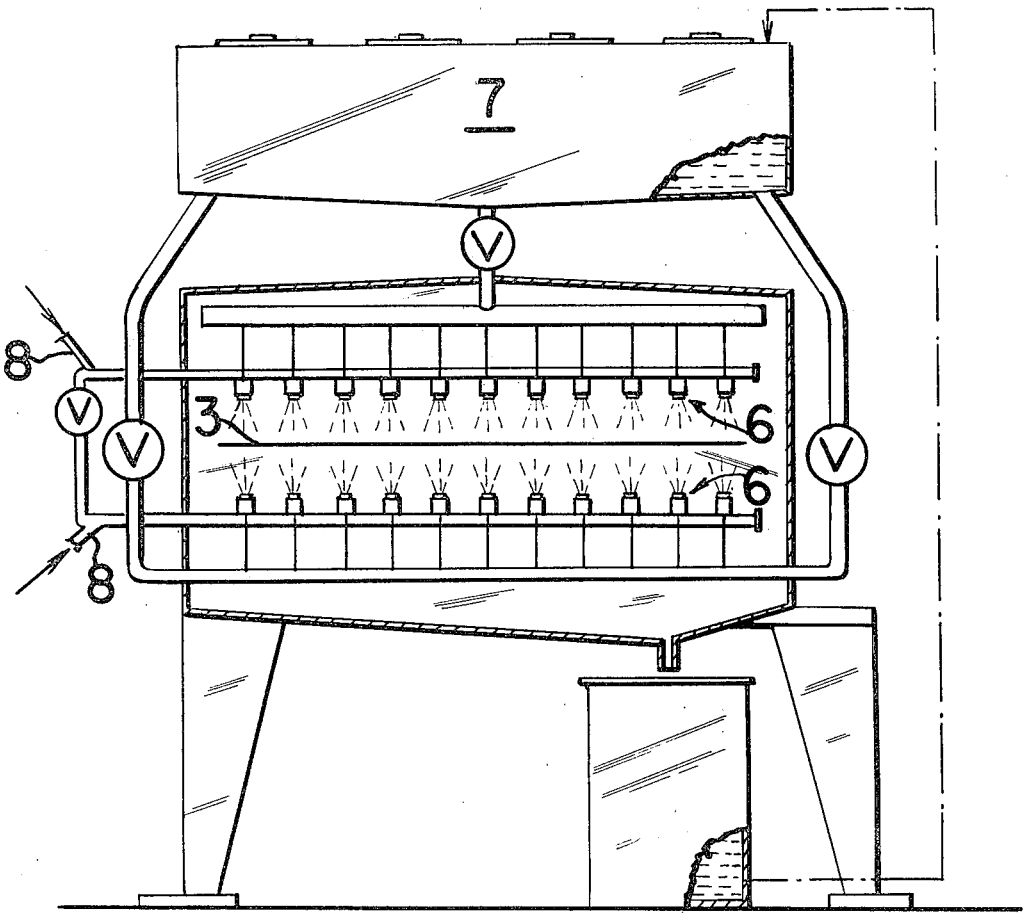
FIG. 3 is a cross-sectional view through the treatment zone of the process of the invention.

FIG. 3 shows a cross-section through the treatment zone. The numbers in this figure have the same significance as given above.

The storage tank for the treatment solution is preferably located above the treatment zone, as shown in the figures. No complex pressure and control pumps are necessary for the filling of this tank; simple feed pumps normally used for the feeding of corrosive liquids are adequate.

The number of two-component jet nozzles located above and below the metal band is finally determined by the width of the metal band or sheet to be treated. However, care must be taken in all cases that every part of the metal surface passing through the treatment zone is covered by the spray stream of the treatment solution. With respect to this and to the various speeds at which the metal bands traverse the treatment zone, the arrangement of several rows of jets, one following the other, staggered, if necessary, may be of advantage. The arrangement of the jets found in conventional spray equipment is generally also suitable for the process according to the invention.

Any compressed gas that is inert with respect to the chemicals that are used, as well as to the metal surfaces to be treated, can generally be used for the process according to the invention. However, the treatment solutions are sprayed preferably with compressed air.

The compressed air to be used should preferably have a pressure of at least 0.1 bar over atmospheric, to guarantee an adequate spraying of the treatment solutions on the metal surface. However, even lower pressures lead to satisfactory results with respect to the produced conversion layers. In view of an optimal control of the amounts of liquid to be sprayed, and combined with this, of an effective distribution of the treatment solution on the metal surfaces, the adjustment of the pressure of the compressed air to a figure in the range from 0.7 to 4 bar, or the variation in this range, has proved to be particularly advantageous. The use of greater pressure is also possible within the framework of the process according to the invention, but does generally not lead to better results.

In the interest of a uniform development of the conversion layers, the liquids are sprayed on preferably in amounts of 1 to 50 ml treatment solution per square meter of metal surface, with the amount of liquid being controlled by a respective regulation of the pressure of the compressed air. However, the process according to the invention generally permits the spraying of smaller or larger amounts of liquid as well.

The temperature of the treatment solution usually is in the range of the room temperature at the time of spraying. However, the solutions may also have higher temperatures, for example in the range from 30° C. to 70° C., if desired.

Within the limits of the above-mentioned preferred ranges for the amount of liquid, the spraying of approximately 15 to 50 ml treatment solution per square meter metal surface makes a post-treatment of these necessary to remove that part of the solution which was not used to develop the layer, from the metal surface. After passing through the treatment zone, the metal band first traverses a "reaction zone" within a period of about 2 to 4 seconds, in which the sprayed-on treatment solution reacts with the metal surface to form the conversion layer or in which this reaction is completed, respectively. Subsequently, the excess treatment solution is removed by squeezing with rollers and/or rinsing with water, which is repeated if desired, the last rinse preferably being carried out with demineralized water. However, a final rinse with chromic acid solution can be applied in a known manner, to render the metal surface passive, if desired. The metal surfaces are then dried in the usual manner.

Thanks to the pressure regulation in combination with the use of two-component jet nozzles, the process according to the invention also allows the spraying of considerably smaller amounts of liquid. In this sense, the spraying of 3 to 7 ml treatment solution per square meter metal surface is particularly preferred. The advantage of this preferred procedure can be found in the complete consumption of the sprayed-on solution for the development of the conversion layer, which consequently makes a removal of excess treatment solution from the metal surface superfluous. This procedure does not result in any waste water contaminated with treatment solution, which requires subsequent treating. In addition, the complete utilization of the sprayed treatment solution for the formation of the layer is of greatest interest in view of the economy of the overall process.

Consequently, the direct drying of the solution sprayed on the metal surface after a reaction time of especially 2 to 4 seconds, without rinsing and/or squeezing, by treating the metal surface with warm air until the adhering water is removed, has proven to be particularly advantageous within the framework of the process according to the invention. This treatment is carried out advantageously in a drying zone next to the reaction zone, in which the temperature of the metal surfaces can be raised to a maximum of 100° C.

The process according to the invention offers one more crucial advantage in contrast to the conventional spray methods. With the known methods, usually both sides, that is, the upper as well as the lower side, of the metal band or sheet to be treated are sprayed with solution. The process according to the invention allows the treatment of only one side, for example, the upper side, of the metal band or sheet, since the control over the amount of liquid by means of compressed air is better and, in connection with this, the amount of sprayed treatment solution is small. Consequently, solution is sprayed on only one side of the band, or sheet-like metal surface, and compressed air is fed simultaneously to the opposite side in another, preferred procedure. This simultaneous feed of compressed air results, on the one hand, in a straight passing of the metal bands or sheets through the treatment zone, that means, a sagging or bending downward is prevented thereby and prevents, on the other hand, an undesirable running of the treatment solution from one side to the other. In addition, the drying process can already be initiated by supplying heated compressed air, if desired.

The conversion layers obtained by the process according to the invention definitely correspond to the layers resulting from conventional spray methods with respect to thickness of the layer and quality.

The performance of the process according to the invention is explained in more detail in the following examples. They are not to be deemed limitative, however.

EXAMPLE 1

Pretreatment of the Metal Surfaces

Band material of aluminum, steel, as well as galvanized steel was degreased and cleaned in the following manner in a continuous belt spray machine. Th band width of the material was 1.50 m; the band speed was through the apparatus 30 m/minute.

a. Predegreasing was conducted with an aqueous solution containing 4 gm/l NaOH
5 gm/l $Na_5P_3O_{10}$
0.3 gm/l organic complexing agent
0.7 gm/l nonionic wetting agent
Spraying for 10 seconds (upper and lower side) at 65° and 1.5 bar over atmospheric pressure.

b. Postdegreasing was conducted with an aqueous solution containing 2 gm/l NaOH
2.5 gm/l $Na_5P_3O_{10}$
0.15 gm/l organic complexing agent
0.35 gm/l nonionic wetting agent
Spraying for 10 seconds (upper and lower side) at 65° C. and 1.5 bar over atmospheric pressure.
Rotating brushes were used in addition for the degreasing of steel surfaces, to increase the cleaning action.

c. Rinsing with warm water by spraying from above and below, for 2 seconds at a water temperature of 50° C. and a spray pressure of 1.5 bar, with subsequent squeezing off of the remaining liquid film on the upper and lower side of the band by means of rubber squeezing rollers.

The producing of conversion layers on the respective band materials pretreated in the above manner is described in the following examples. For this purpose, the band material was introduced from the last rinsing zone, after passing an open stretch of approximately 0.8 m, into the next treatment zone. This was equipped, above as well as underneath the band, with two lines each of jet nozzles arranged one behind the other, with ten two-component jets abreast.

EXAMPLE 2

Treatment of Band Material of Steel or Aluminum

The metal surfaces, top and bottom, were sprayed with an aqueous solution that contained 2.4 gm/l iron-III-nitrate
1.5 gm/l HF
0.1 gm/l $CrO_3$ at a spray temperature of 40° C. The amount of sprayed liquid was 30 ml/m$^2$ of metal surface at a pressure of 4 bar (compressed air). After a subsequent reaction time of 4 seconds, the band material passed through a pair of squeezing rollers and two successive rinsing zones and was then dried.

EXAMPLE 3

Treatment of Band Material of Galvanized Steel

The metal surfaces, top and bottom, were sprayed with an aqueous solution that contained 8 gm/l $CrO_3$
9 gm/l $HNO_3$
0.05 gm/l HF at a spray temperature of 40° C. The amount of sprayed liquid was 40 ml/m$^2$ of metal surface at a pressure of 4 bar (compressed air). After a subsequent reaction time of 4 seconds, the band material passed through a pair of squeezing rollers as well as two successive rinsing zones and was then dried.

EXAMPLE 4

Treatment of Aluminum Band for Cans

The metal surfaces, top and bottom, were sprayed with an aqueous solution that contained 12.5 gm/l $H_3PO_4$
7.5 gm/l triethanolamine
1.5 gm/l zirconium ions
2.5 gm/l polymer resin (a water-dispersible film-forming resin)

at a spray temperature of 40° C. The bath was prepared with completely deionized water. The sprayed liquid amounted to 6 ml/m$^2$ of metal surface, at a pressure of 2 bar (compressed air). After a subsequent reaction time of 4 seconds, the band material was introduced immediately into a drying zone and dried with warm, circulating air. An excellent conversion layer was obtained of uniform thickness.

EXAMPLE 5

Treatment of Band Material of Steel or Galvanized Steel

The upper side of the band material was sprayed with an aqueous solution that contained 6 gm/l $CrO_3$
2 gm/l $H_3PO_4$
3.2 gm/l polymer resin at a spray temperature of 40° C. The bath was prepared also with completely deionized water. The sprayed amount of liquid was 5 ml/m$^2$ of upper metal surface, at a pressure of 2 bar (compressed air). Compressed air only, of a comparable pressure, was fed immediately to the underside of the band material. After a subsequent reaction time of 4 seconds, the band material was introduced immediately into a drying zone and dried with warm circulating air. An excellent conversion layer was obtained of uniform thickness, free of pinholes or other types of misses.

The preceding specific embodiments are illustrative of the practice of the invention. It is to be understood, however, that other expedients known to those skilled in the art or disclosed herein, may be employed without departing from the spirit of the invention or the scope of the appended claims.

I claim:

1. In the process for the production of conversion layers continuously on a continuously moving band or sheet-like metal surfaces of aluminum, zinc or iron, by the application of a solution creating a layer on said metal surfaces selected from the group consisting of a chromating solution, an acid solution free of chromic acid and containing fluorides and compounds of titanium, zirconium or manganese, an acid solution free of chromic acid and containing fluorides, and an acid solution free of chromic acid and containing compounds of titanium, zirconium or manganese, by the stationary spray method, onto the cleaned and rinsed metal surface, and subjecting said metal surfaces to customary aftertreatments, the improvement consisting in that said solution in a sufficient amount at a sufficient concentration to deposit a uniform layer of from 0.01 to 1 gm/m$^2$ on said metal surfaces is sprayed through at least one two-component jet spray nozzle with the aid of an inert compressed gas where said solution and said compressed gas are fed separately each to an opening in said two-component jet spray nozzle.

2. The process of claim 1 wherein said inert compressed gas is air.

3. The process of claim 1 or 2 wherein said inert compressed gas has a pressure of at least 0.1 bar over atmospheric pressure.

4. The process of claim 3 wherein said pressure is from 0.7 to 4 bar over atmospheric pressure.

5. The process of claim 1 or 2 wherein from 1 to 50 ml of solution creating a layer on said metal surfaces are sprayed per square meter of said metal surface.

6. The process of claim 1 or 2 wherein from 3 to 7 ml of solution creating a layer on said metal surfaces are sprayed per square meter of said metal surface.

7. The process of claim 6 wherein said solution sprayed on said metal surface is dried with circulating, warm air until the water is removed, after a reaction time of about 2 to 4 seconds without subsequent rinsing and/or squeezing.

8. The process of claim 7 wherein said solution is sprayed only on one side of said metal surface and compressed air is fed simultaneously to the other side.

* * * * *